US007198220B2

(12) United States Patent
Knowlton

(10) Patent No.: US 7,198,220 B2
(45) Date of Patent: Apr. 3, 2007

(54) METHOD OF WINDING TWO OVERLAPPED SHEETS WITH PREAPPLIED SEAM TAPE

(75) Inventor: Michael Knowlton, Newville, PA (US)

(73) Assignee: Carlisle Management Company, Syracuse, NY (US)

( * ) Notice: Subject to any disclaimer, the term of this patent is extended or adjusted under 35 U.S.C. 154(b) by 571 days.

(21) Appl. No.: 10/770,234

(22) Filed: Feb. 2, 2004

(65) Prior Publication Data

US 2004/0154265 A1 Aug. 12, 2004

(51) Int. Cl.
*B65H 18/08* (2006.01)

(52) U.S. Cl. ..... 242/530.2; 242/160.4; 52/746.11; 52/748.1; 156/184

(58) Field of Classification Search ..... 242/530.2, 242/159, 160.1, 160.4, 444.2, 530.1, 532.3, 242/918, 919; 156/71, 289, 184; 428/906, 428/40.1, 343, 194, 201; 52/409, 411, 746.1, 52/746.11, 748.1

See application file for complete search history.

(56) References Cited

U.S. PATENT DOCUMENTS

| | | | | |
|---|---|---|---|---|
| 1,062,400 | A * | 5/1913 | Irving | 428/189 |
| 2,502,749 | A * | 4/1950 | Reid | 428/43 |
| 2,589,202 | A | 3/1952 | Newman | 282/19 |
| 2,782,914 | A | 2/1957 | Giles | 206/59 |
| 3,386,527 | A | 6/1968 | Daubert et al. | 181/33 |
| 4,007,835 | A | 2/1977 | Klothe | 206/411 |
| 4,421,807 | A | 12/1983 | Clausing et al. | 428/41 |
| 4,715,915 | A | 12/1987 | Vanderzee | 156/182 |
| 4,735,838 | A | 4/1988 | Roberts et al. | 428/40 |
| 4,751,122 | A | 6/1988 | May | 428/41 |
| 4,767,653 | A | 8/1988 | Renstrom | 428/40 |
| 4,948,638 | A | 8/1990 | Francis | 428/35.2 |
| 4,950,511 | A | 8/1990 | Francis | 428/35.2 |
| 5,182,156 | A | 1/1993 | Pape et al. | 428/130 |
| 5,469,671 | A | 11/1995 | Rathgeber et al. | 52/58 |
| 5,658,632 | A | 8/1997 | Krabill | 428/423 |
| 5,747,131 | A | 5/1998 | Kreckel | 428/40 |
| 5,806,271 | A | 9/1998 | Van Someren et al. | 52/750 |
| 5,935,669 | A | 8/1999 | Leeuwenburgh | 428/40.1 |
| 6,124,018 | A | 9/2000 | Yoshino | 428/40.1 |
| 6,217,692 | B1 | 4/2001 | Kling | 156/229 |
| 6,378,259 | B1 | 4/2002 | Carlson | 52/408 |
| 7,044,411 | B2 * | 5/2006 | Knowlton | 242/160.1 |
| 2004/0187432 | A1 * | 9/2004 | Robison et al. | 52/741.1 |

* cited by examiner

*Primary Examiner*—Patrick Mackey
*Assistant Examiner*—William E. Dondero
(74) *Attorney, Agent, or Firm*—Wood, Herron & Evans, L.L.P.

(57) ABSTRACT

EPDM or other roof membrane with preapplied seam tape is formed into a roll by forming two sheets and placing one on top of the other. The seam tape of the first sheet is at one end and facing one direction whereas the seam tape of the adjoining sheet is at the opposite side and facing the opposite direction, either up or down. The two sheets are then rolled up together. Since the combined thickness of the two sheets is constant throughout, the diameter of the roll is likewise constant throughout.

4 Claims, 1 Drawing Sheet

METHOD OF WINDING TWO OVERLAPPED SHEETS WITH PREAPPLIED SEAM TAPE

BACKGROUND

Single-ply membrane sheeting incorporates a single-ply membrane as a water barrier for a roof surface, pond liner, or the like. As it is impractical to manufacture sheeting wide enough to cover an entire roof or pond, individual sheets are adhered together along lap seams to form a continuous water impervious sheet.

In the past the lap seams have been completely formed at the construction site. This requires that, when necessary, the overlapping edges be cleaned, a primer applied and then an adhesive. Adhesive seam tape is frequently used to form a lap seam. There are a variety of different seam tapes that can be applied. These are very tacky. Upon contact they adhere to the sheeting.

In order to reduce on-site labor, it is desirable to have the seam tape preapplied to the roofing membrane. Unfortunately, when one preapplies seam tape to the edge of a membrane, it interferes with storing and shipping the sheeting. Typically the sheeting is rolled onto a cylindrical core. Because ordinary sheeting has a uniform thickness, one can roll an indefinite length of material on the core. However, when a seam tape is applied to the edge of the sheeting, it cannot be simply rolled. The seam edge is nearly twice as thick as the remaining portion 5 of the sheet. Rolling this would form a conical-shaped roll. This interferes with shipping.

SUMMARY OF THE INVENTION

The present invention is premised on the realization that membrane sheeting with preapplied seam tape along one edge can be rolled up into a roll having a generally uniform diameter across the length of the roll by rolling two membrane sheets together at the same time. The first sheet will have the seam tape along one edge, preferably facing upward. The second sheet will have the seam at the opposite end, preferably facing downward with the non-seam tape edge of each sheet abutting the seam tape of the overlying or underlying sheet. Thus the two sheets do not cover the seam tape of the adjoining sheets thereby maintaining a uniform thickness across the entire sheet. This can easily be rolled up and shipped.

The objects and advantages of the present invention will be further appreciated in light of the following detailed description and drawings in which:

DETAILED DESCRIPTION

Figure 1:
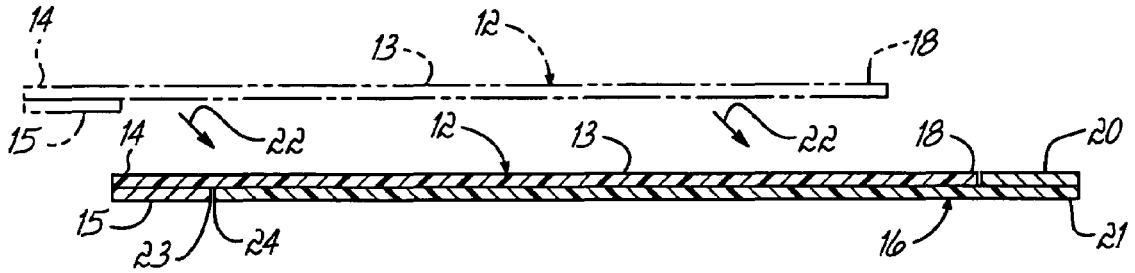
FIG. 1 is a cross-sectional view taken at lines 1—1 of FIG. 2 with a diagrammatic depiction of the placement of an adjoining sheet.
Figure 2:
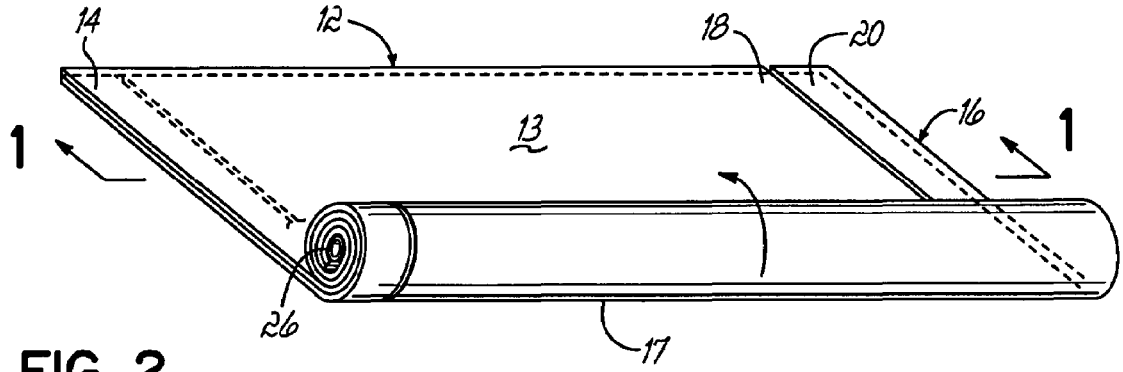
FIG. 2 is a perspective view of the sheeting of the present invention as it is rolled up.

As shown in FIG. 1, the present invention is roof sheeting 12 which incorporates a field portion 13 and an edge portion 14. Edge portion 14 includes a layer of seam tape 15 applied along the edge. As shown, there is a first sheet 12 and a second identical sheet 16 used to form roll 17.

The membrane sheeting can be any material used for roofing and pond liner application. These include EPDM, thermoplastic elastomers, butyl rubber, PVC, and the like. The thickness of the membrane can be 30 to 60 mils, and is generally 45 to 60 mils. The thickness of the tape is less than or equal to the thickness of the membrane, and is generally 35 mils.

The seam tape may be any type of seam tape used in the roofing industry. It may be thermoplastic or thermosetting. Preferably, it is a pressure sensitive tape. There are several commercially available seam tapes available for use in the roofing industry. Although the width of the seam tape can vary depending on type and application requirements, it will generally be at least about 3 inches wide.

The method of applying the seam tape 15 to the membrane sheeting 12 of the present invention does not form part of the present invention. The seam tape is generally applied in the factory by first applying a primer layer along the clean edge 14 of the membrane.

Subsequently the seam tape 15 is pressed against the membrane along the edge 14. The exposed surface of the seam tape is generally covered with a protective release sheeting (not shown).

One way to apply the seam tape is to roll a length of roofing membrane onto a surface such as a floor and manually apply the tape. The roofing membrane is preferably clean sheeting. If not, any talc or the like must be removed prior to application of the tape.

Alternatively, a double wide tape (i.e., 6–7 inches wide) can be applied along the center line of the sheeting. The sheeting can then be cut along the center of the seam tape to form two sheets of equal width. Again, the method of forming the sheeting with the applied seam tape forms no part of the present invention.

As shown in the present invention, sheet 12 is formed with the seam tape 15 at edge 14 and the opposite edge 18 being uncoated. The second sheet 16 is oriented so that the seam tape 20 covered edge 21 is opposite edge 14 of sheeting 12. Sheet 12 is placed directly onto sheet 16 as indicated by arrows 22. The inner edge 23 of the seam tape 15 is juxtaposed to the edge 24 of sheet 16. As shown, the seam tapes 15 and 20 face in opposite directions. It is also possible to have the seam tapes facing the same direction as long as the uncoated edge 18 of sheet12 does not overlie the seam tape coated edge 21 of sheet 16. Preferably, both sheets have the same width.

Once the two sheets are positioned on each other, they can be rolled in a standard fashion on a cardboard roll 26 permitting them to be easily moved and shipped to the job site. Thus, there will be no bulges at either edge of the roll 17.

One on the job site, both sheets would be unrolled, separated and positioned for use. Because they have the preapplied seam tape, lap seams can be more easily formed between the seam tape coated edge of one membrane with the non-coated edge of an adjacent membrane.

This has been a description of the present invention along with the preferred method of practicing the present invention. The invention itself should only be defined by the appended claims whereby,

I claim:

1. A method of rolling a first and second membrane sheet each with preapplied seam tape along a seam tape edge comprising placing one of said sheets on top of the other sheet with the seam tape edge of each of said sheets at opposite sides and with a non-seam tape edge of each of said sheets not overlying the seam tape of the other sheet.

2. The method claimed in claim 1 wherein the seam tape on the first and second sheets face in opposite directions with the non seam tape edge of the first sheet adjacent the seam tape of the second sheet.

3. The method claimed in claim 1 wherein said first and second sheets have the same width.

4. The method claimed in claim 1 wherein said sheets are EPDM roofing membrane.

* * * * *